US010139143B2

(12) United States Patent
Havard, Jr. et al.

(10) Patent No.: US 10,139,143 B2
(45) Date of Patent: Nov. 27, 2018

(54) AIR CONDITIONER WITH MULTIPLE EXPANSION DEVICES

(71) Applicant: Lennox Industries Inc., Richardson, TX (US)

(72) Inventors: Harold Gene Havard, Jr., Terrell, TX (US); Terry Jewell, Dallas, TX (US); Yi Qu, Coppell, TX (US)

(73) Assignee: Lennox Industries Inc., Richardson, TX (US)

( * ) Notice: Subject to any disclaimer, the term of this patent is extended or adjusted under 35 U.S.C. 154(b) by 727 days.

(21) Appl. No.: 14/109,697

(22) Filed: Dec. 17, 2013

(65) Prior Publication Data

US 2015/0168041 A1 Jun. 18, 2015

(51) Int. Cl.

| | |
|---|---|
| ***F25B 49/00*** | (2006.01) |
| ***F25B 49/02*** | (2006.01) |
| ***F25B 41/04*** | (2006.01) |

(52) U.S. Cl.

CPC ..... *F25B 49/02* (2013.01); *F25B 41/04* (2013.01); *F25B 2341/0661* (2013.01); *F25B 2400/075* (2013.01); *F25B 2600/2507* (2013.01); *F25B 2600/2513* (2013.01); *F25B 2700/13* (2013.01)

(58) Field of Classification Search

CPC ..... F25B 49/02; F25B 41/04; F25B 2700/13; F25B 2600/2507; F25B 2400/075; F25B 2600/2513

See application file for complete search history.

(56) References Cited

U.S. PATENT DOCUMENTS

2001/0022090 A1* 9/2001 Takano ..... B60H 1/00914 62/228.5
2004/0216477 A1* 11/2004 Yamasaki ..... F25B 1/10 62/216
2006/0230782 A1* 10/2006 Imai ..... F04C 18/3564 62/512
2009/0025420 A1* 1/2009 Kojima ..... F24F 1/0059 62/527
2009/0242652 A1* 10/2009 Hong ..... B60H 1/3211 236/46 R
2011/0030397 A1* 2/2011 Taras ..... F24F 3/153 62/90
2011/0146313 A1* 6/2011 Finckh ..... F25B 9/008 62/186
2011/0162407 A1* 7/2011 Gist ..... A23G 9/28 62/389

FOREIGN PATENT DOCUMENTS

JP H06147661 A * 5/1994
JP 2001263902 A * 9/2001
(Continued)

OTHER PUBLICATIONS

Haruhisa et al., Refrigerant Cycle Device, Oct. 14, 2004, JP2004286329A, Whole Document.*
(Continued)

*Primary Examiner* — Larry Furdge
(74) *Attorney, Agent, or Firm* — Winstead PC

(57) ABSTRACT

In various implementations, an air conditioner may include more than one expansion device. Refrigerant flow through the expansion device(s) may be controlled based at least partially on an operational property of the air conditioner.

19 Claims, 4 Drawing Sheets

(56) References Cited

FOREIGN PATENT DOCUMENTS

| | | | |
|---|---|---|---|
| JP | 2004286329 A | * | 10/2004 |
| JP | 2006200758 A | * | 8/2006 |

OTHER PUBLICATIONS

Tsutomu et al., Refrigerator, Sep. 26, 2001, JP2001263902A, Whole Document.*
Matsumoto, Air Conditioner, Aug. 3, 2006, JP2006200758A, Whole Document.*
Yoshida et al., Air Conditioner, May 27, 1994, JPH06147661A, Whole Document.*

* cited by examiner

AIR CONDITIONER WITH MULTIPLE EXPANSION DEVICES

TECHNICAL FIELD

The present disclosure relates generally to air conditioners with a system of multiple expansion devices.

BACKGROUND

Air conditioners experience pressure variations during operation. Different settings of air conditioners may affect the pressures in portions of the air conditioner. Pressure swings may affect operations of the air conditioner (e.g., cause shut-downs, cause mechanical failure, and/or reduce efficiencies).

SUMMARY

Air conditioners experience pressure variations during operation. Different settings of air conditioners may affect the pressures in portions of the air conditioner. Pressure swings may affect operations of the air conditioner (e.g., cause shut-downs, cause mechanical failure, and/or reduce efficiencies).

In various implementations, an air conditioner may include a condenser including an outlet, a set of compressors, a first expansion device, a second expansion device, a memory, and a controller (e.g., a programmable logic device including a processor that executes instructions stored in the memory). The set of compressors may include one or more compressors, which may include a low compressor setting and one or more high compressor settings. The volumetric flow rate of refrigerant exiting the set of compressors may be greater at the one or more high compressor settings than at the low compressor setting. The first expansion device may allow refrigerant to flow at a first volumetric flow rate. The second expansion device may allow refrigerant to flow at a second volumetric flow rate and the second volumetric flow may be greater than the first volumetric flow rate. The first expansion device and the second expansion device may be coupled in parallel. The memory of the air conditioner may store one or more properties of compressor settings. The controller may determine a third volumetric flow rate of refrigerant exiting the set of compressors; retrieve one or more properties of compressor settings; and determine a compressor setting of the set of compressors based at least partially on the determined third volumetric flow rate and one or more retrieved properties of compressor settings. The controller may allow refrigerant from the outlet of the condenser to flow through the first expansion device if the determined compressor setting comprises the low compressor setting. The controller may allow refrigerant from the outlet of the condenser to flow through the second expansion device if the determined compressor setting comprises one of the high compressor settings.

Implementations may include one or more of the following features. The air conditioner may include a reversing valve. The reversing valve may include a first valve setting and a second valve setting. The first valve setting may allow refrigerant flow through the first expansion device. The second valve setting may allow refrigerant flow through second expansion device. The air conditioner may include a first valve and a second valve. The first valve may regulate flow through the first expansion device. The second valve may regulate flow through the second expansion device. In some implementations, the set of compressors may include a first compressor and a second compressor coupled in a tandem compressor assembly. The set of compressors may include a variable speed compressor. The first expansion device and/or the second expansion device may include a thermal expansion device. In some implementations, the condenser may include a microchannel condenser. The first expansion device may include a first orifice and the second expansion device may include a second orifice. The first expansion device and/or the second expansion device may include a bleed thermal expansion device. At least one of the compressors may include more than one stage of operation.

In various implementations, operation of an air conditioner may be allowed. The air conditioner may include compressor settings, a first expansion device, and a second expansion device. The compressor settings may include a low compressor setting and at least one high compressor setting. The volumetric flow rate of refrigerant exiting a set of compressors of the air conditioner may be greater at the at least one high compressor setting than at the low compressor setting. The first expansion device may allow refrigerant to flow at a first volumetric flow rate. The second expansion device may be coupled in parallel with the first expansion device. The second expansion device may allow refrigerant to flow at a second volumetric flow rate. The second volumetric flow rate may be greater than the first volumetric flow rate. A compressor setting of the set of compressors may be determined. Refrigerant from an outlet of a condenser of the air conditioner may be allowed to flow through the first expansion device if the determined compressor setting comprises the low compressor setting. Refrigerant from the outlet of the condenser may be allowed to flow through the second expansion device if the determined compressor setting comprises one of the high compressor settings.

Implementations may include one or more of the following features. At least one high compressor setting may include a first high compressor setting and a second high compressor setting. The second high compressor setting may be associated with a higher volumetric flow rate exiting the set of compressors than the first high compressor setting. In some implementations, refrigerant from the outlet of the condenser may be allowed to flow through the first expansion device and the second expansion device if the determined compressor setting comprises the second high compressor setting. Determining a compressor setting may include determining a compressor setting based at least partially on a volumetric flow rate of a refrigerant proximate an outlet of at least one compressor of the air conditioner. In some implementations, determining a compressor setting may include determining a third volumetric flow rate of refrigerant exiting at least a portion of the set of compressors, and comparing the determined third volumetric flow rate to a predetermined low flow rate. The compressor setting may be identified as the low compressor setting if the determined third volumetric flow rate is less than the predetermined low flow rate. In some implementations, the determined third volumetric flow rate may be compared to a predetermined high flow rate. The compressor setting may be identified as one of the high compressor settings if the determined third volumetric flow rate is greater than the predetermined high flow rate.

In various implementations, an air conditioner may include a microchannel condenser, a first expansion device, a second expansion device, at least one valve, a set of compressors, sensor(s), a memory, and a controller (e.g., a processor executing instructions stored on a memory to allow one or more operations). The first expansion device may allow refrigerant to flow at a first volumetric flow rate and the second expansion device may allow refrigerant to flow at a second volumetric flow rate. The second volumetric flow rate may be greater than the first volumetric flow rate. The first expansion device and the second expansion device may be coupled in parallel. At least one of the valves of the air conditioner may manage refrigerant flow to the first expansion device and/or the second expansion device. The set of compressors may include one or more compressors. Sensor(s) may measure one or more of a third volumetric flow rate exiting at least a portion of the set of compressors. A memory of the air conditioner may store predetermined flow rate(s) and at least one of the predetermined flow rates may include a first predetermined volumetric flow rate. The controller may determine at least one of the third volumetric flow rates using at the sensor(s) and retrieve the first predetermined volumetric flow rate. Refrigerant from an outlet of a condenser of the air conditioner may be allowed to flow through the first expansion device if at least one of the determined third volumetric flow rates is less than the first predetermined volumetric flow rate. Refrigerant from the outlet of the condenser may be allowed to flow through the second expansion device if at least one of the determined third volumetric flow rates is greater than or equal to the first predetermined volumetric flow rate.

Implementations may include one or more of the following features. At least one of the valves may include a reversing valve. The reversing valve may include a first valve setting, which may allow refrigerant flow through the first expansion device, and a second valve setting, which may allow refrigerant flow through second expansion device. At least one valve may include a first valve, which may regulate flow through the first expansion device, and a second valve, which may regulate flow through the second expansion device. The set of compressors may include a first compressor and a second compressor coupled in a tandem assembly. At least one of the compressors may include more than one stage of operation. At least one of the predetermined flow rates may include a predetermined high flow rate greater than the first predetermined flow rate. In some implementations, the controller may retrieve the predetermined high flow rate from the memory of the air conditioner. The controller may allow refrigerant from an outlet of the condenser to flow through the first expansion device and the second expansion device if at least one of the determined third volumetric flow rates is greater than the predetermined high flow rate.

In various implementations, an air conditioner may include one or more compressors, a microchannel condenser, and/or expansion devices. Refrigerant flow through expansion device(s) of the air conditioner may be controlled based at least partially on an operational property (e.g., such as compressor properties, including compressor settings and/or refrigerant flow rates exiting the compressor(s)).

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Air conditioners may include components (e.g., multistage compressors, microchannel condensers and/or including more than one compressor) that alter the flow rate of refrigerant exiting the compressor. As the flow rate of refrigerant exiting the compressor fluctuates, pressures in portions of the air conditioner may fluctuate and/or efficiencies (e.g., cost and/or IEER, integrated energy efficiency ratio) may fluctuate. In various implementations, more than one expansion device may be utilized to adjust air conditioner operations based on the fluctuations. Adjusting the air conditioner operations may increase the efficiency over a range of operations (e.g., when compared with utilized a single expansion device).

Figure 1A:
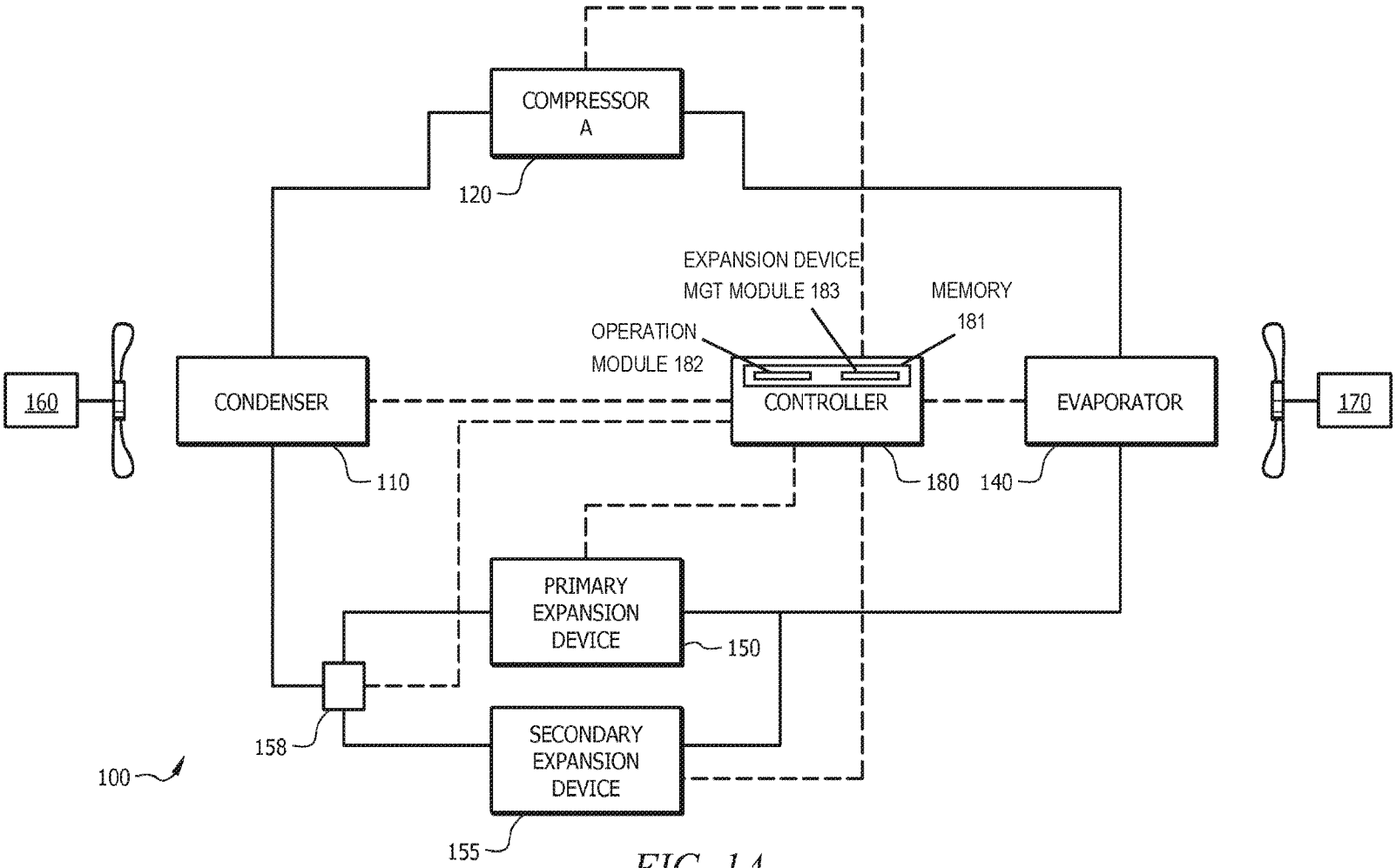
FIG. 1A illustrates an implementation of an example air conditioner with a valve for managing refrigerant flow to expansion devices.

For example, refrigerant flow through expansion device(s) of the air conditioner may be controlled based at least partially on an operational property (e.g., such as compressor properties including compressor settings and/or refrigerant flow rates exiting the compressor(s)). FIG. 1A illustrates an implementation of an example air conditioner 100 with a valve for managing refrigerant flow to expansion devices.

The air conditioner 100 may include components such as a condenser 110, a set of compressors including at least one compressor A 120, an evaporator 140, a primary expansion device 150, a secondary expansion device 155, and at least one first valve 158. Lines (e.g., tubing) may couple various components and allow refrigerant to flow in and/or out of various components of the air conditioner 100. Fans 160, 170 may cause air to flow through the condenser 110 and/or the evaporator 170.

The condenser 110 may include any appropriate condenser. In some implementations, the condenser 110 may be a microchannel condenser (e.g., condenser with a channel size less than approximately 1 mm). Microchannel condensers may be sensitive to operating conditions during operation of the air conditioner (e.g., when compared with other condensers (e.g., condenser with tube size greater than 5 mm)). For example, microchannel condensers may be sensitive to refrigerant charge (e.g., a level of refrigerant in the system). When a microchannel condenser has a refrigerant charge greater than a maximum operating charge, the pressure in the microchannel condenser may become elevated due to the refrigerant capacity size difference between the microchannel condenser and the evaporator. Microchannel condensers may be sensitive to operating conditions, such as ambient temperatures, during operations. For example, as the ambient temperatures elevates above a predetermined high ambient temperature (e.g., approximately 95 degrees Fahrenheit and/or approximately 116 degrees Fahrenheit), pressures in the microchannel condenser may become elevated. The high pressures (e.g., pressures greater than approximately 615 psi, with a refrigerant that includes R-410A refrigerant) may cause mechanical failure, including prefailure events, such as excessive wear on parts, and/or high pressure switch activations. In some implementations, when refrigerant pools in portions of the air conditioner (e.g., due to closure of valves and/or shut down of one or more components of the air conditioner), the pressure in the microchannel condenser may become elevated (e.g., since the capacity of the microchannel condenser may be substantially smaller than the total capacity of the air conditioner accumulation of refrigerant proximate the microchannel may cause high pressures) and mechanical failure of the air conditioning system may occur.

In various implementations, the set of compressors may include at least one compressor A 120. The compressor(s) of the set of compressors may include any appropriate compressor. For example, in some implementations, compressor A 120 may include a single stage and/or multi-stage (e.g., more than one stage) compressors. The compressor A 120 may include discrete stages and/or be a variable speed compressor.

The set of compressors may include one or more settings. A setting may correspond to an output of the set of compressors or portions thereof (e.g., a single compressor and/or a set of tandem compressors). For example, single stage compressors may include one setting; the compressor may be allowed to operate and/or operation may be restricted. A two stage compressor may include two settings. The two settings may include allowing operation of a compressor at a low setting, at a high setting, and/or the operation of the compressor may be restricted. The low setting may allow refrigerant to exit the compressor at a lower volumetric flow rate than the high setting. A multi-stage compressor and/or a variable stage compressor may include a low setting and one or more high settings. The low setting may allow refrigerant to exit the compressor at a lower volumetric flow rate than the one or more high settings.

As illustrated, the air conditioner may include a primary expansion device 150 and a secondary expansion device 155, as illustrated. The primary expansion device 150 and the secondary expansion device 155 may be coupled in parallel in the air conditioner.

The primary expansion device 150 and/or the secondary expansion device 155 may include any device that at least partially expands refrigerant passing through the device. For example, the primary expansion device 150 and/or the secondary expansion device 155 may include a thermal expansion valve, a bleed thermal expansion valve (e.g., a thermal expansion valve with a bleed, such as a groove), an orifice, and/or an electronic expansion valve. In various implementations, the primary expansion device may allow fluid to exit the outlet of the primary expansion device at a first flow rate and/or the secondary expansion device may allow fluid to exit an outlet of the secondary expansion device at a second flow rate. The first flow rate may be less than the second flow rate. For example, the primary expansion device may include a low speed orifice and/or the secondary expansion device may include a high speed orifice. In some implementations, the primary expansion device may include a high speed orifice and/or the secondary expansion device may include a low speed orifice.

At least one valve 158 may manage refrigerant flow to the primary expansion device 150 and/or the secondary expansion device 155. The valve(s) may include any appropriate valve 158, such as a reversing valve, a two way valve, a three way valve, a solenoid valve, a smart valve, and/or any other appropriate valve. As illustrated in FIG. 1A, the valve 158 may couple the outlet of the condenser to the primary expansion device 150 and the secondary expansion device 155 (e.g., the valve may be disposed in a line coupling the condenser 110 and the primary expansion device 150 and the secondary expansion device 155).

The valve 158 may allow various settings. For example, valve 158 may include a first valve setting, a second valve setting, and/or a third valve setting. The first valve setting may allow fluid flow to the first expansion device 150 and/or restrict fluid flow to the secondary expansion device 155. The second valve setting may allow fluid flow to the second expansion device 155 and/or restrict fluid flow to the first expansion device 150. In some implementations, the valve 158 may include a third valve setting. For example, the third valve setting may allow fluid flow through the primary expansion device 150 and the secondary expansion device 155. The valve may allow restriction of fluid flow to the primary expansion device 150 and the secondary expansion device, in some implementations.

A controller 180 (e.g., a computer) may be coupled (e.g., communicably, such as by wires or linked by Wi-Fi) to component(s) of the air conditioner 100 and control various operations of the component(s) (e.g., compressor(s), fan(s), valve(s), condenser, evaporator, and/or other components) and/or system. For example, the controller 180 may include an operation module 182 and/or an expansion device management module 183, stored in a memory 181 of the controller and executable by a processor of the controller 180, to perform various operations of the air conditioner 100. The operation module 182 may control operations of the air conditioner 100, such as receiving requests for operation, determining whether to respond to requests for operation, operating various components (e.g., compressors, reversing valves, and/or expansion valves), etc. The expansion device management module 183 may allow operations of the air conditioner, determine flow rates of refrigerant in portions of the air conditioner, determine compressor setting(s), comparing properties of compressors to properties of compressor settings; determine valve settings, determine whether to allow refrigerant flow through primary expansion device(s) and/or secondary expansion device(s), retrieve predetermined values (e.g., compressor setting properties, predetermined volumetric flow rates, predetermined ranges of volumetric flow rates, predetermined high ambient temperatures, predetermined high pressures, and/or predetermined compressor setting criteria), determine volumetric flow rates exiting at least a portion of a set of compressors, comparing determined volumetric flow rates to predetermined volumetric flow rates, control components (e.g., allow refrigerant flow to a component and/or restrict refrigerant flow to a component) and/or other operations. The expansion device management module 183 may control operation and/or restriction of valves and/or expansion devices of the air conditioner 100. In some implementations, an expansion device management module 183 may adjust the amount of refrigerant allowed to flow through expansion devices.

Although FIG. 1 illustrates an implementation of an air conditioner, other implementations may be utilized as appropriate. For example, the air conditioner may include any components, as appropriate. A high pressure switch may be included to shut down (e.g., restrict operation of the air conditioner) the air conditioner when a pressure in at least a portion of the air conditioner exceeds a predetermined high pressure switch value. In some implementations, the primary expansion device and/or secondary expansion device may include more than one expansion device. The air conditioner may be a heat pump and may include a reversing valve to allow cooling and heating operations. In some implementations, the primary expansion device comprises an orifice and the secondary expansion device comprises an orifice. Orifices may simplify operation and/or control of the operation (e.g., when compared with valves) and/or may reduce costs (e.g., when compared with valves). Refrigerant flow to the orifices may be controlled by the valve 158.

In some implementations, the air conditioner may include a single compressor and a microchannel condenser. Since the microchannel condenser experiences pressure fluctuations during operation (e.g., during period of when ambient temperatures exceed a predetermined high ambient temperature), the valve 158 may be utilized to manage refrigerant flow to the primary and/or secondary expansion device. For example, an ambient temperature of the air conditioner (e.g., a temperature proximate at least a portion of the air conditioner) may affect the pressure of the refrigerant in the air conditioner. As the ambient temperature exceeds a predetermined high ambient temperature (e.g., approximately 95 degrees Fahrenheit and/or approximately 115 degrees Fahrenheit), the controller may determine which expansion device(s) through which to allow refrigerant flow. For example, when the ambient temperature exceeds a predetermined high ambient temperature, refrigerant flow to the secondary expansion device may be allowed and the refrigerant flow to the primary expansion device may be restricted. In some implementations, when an ambient temperature exceeds a predetermined high ambient temperature, refrigerant flow to the primary expansion device and the secondary expansion device may be allowed.

In some implementations, the air conditioner may include a single variable speed compressor. The variable speed compressor may include more than one setting. The primary expansion device and/or the secondary expansion device may include a thermal expansion valve.

In some implementations, the air conditioner may include a single variable speed compressor, a microchannel condenser, and a thermal expansion valve as a primary expansion device. The secondary expansion device may include any appropriate expansion device. During use, when ambient temperatures are determined to exceed a predetermined high ambient temperature, the controller may allow flow to the secondary expansion device in addition to the primary expansion device. Allowing use of the primary and secondary expansion device may allow better control of the air conditioner during the period of elevated ambient temperatures, due to the increased load capacity of the two expansion devices working in parallel (e.g., when compared with utilizing a single thermal expansion valve).

In various implementations, the type of valve may be included in the air conditioner may be based at least partially on the number of valve settings to be utilized in the operation of the air conditioner. In some implementations, the valve 158 may include a reversing valve. The reversing valve 158 may include at least two settings. For example, a first valve setting of the reversing valve may direct flow to the primary expansion device 150 and restrict flow to the secondary expansion device 155. The second valve setting of the reversing valve may direct flow to the secondary expansion device 155 and restrict flow to the primary expansion device 150.

In some implementations, the valve 158 may include a three way valve. The three way valve may be coupled to a line coupling an outlet of the condenser 110 and a line coupling the primary expansion device 150 and/or secondary expansion device 155. The three way valve may include at least three settings. For example, a first valve setting of the three way valve may direct flow to the primary expansion device 150 and restrict flow to the secondary expansion device 155. The second valve setting of the three way valve may direct flow to the secondary expansion device 155 and restrict flow to the primary expansion device 150. The third valve setting may allow fluid flow to the primary expansion device 150 and the secondary expansion device 155. In some implementations, the third valve setting may restrict fluid flow to the primary expansion device and/or the secondary expansion device.

In some implementations, the valve 158 may include a solenoid valve. The solenoid valve may be coupled to the primary expansion device 150 or the secondary expansion device 155. The solenoid valve may include two setting. For example, a first valve setting of the solenoid may open the solenoid; direct flow to the primary expansion device 150; and restrict flow to the secondary expansion device 155. The second valve setting of the solenoid may close the solenoid; may direct flow to the secondary expansion device 155; and restrict flow to the primary expansion device 150.

Figure 1B:
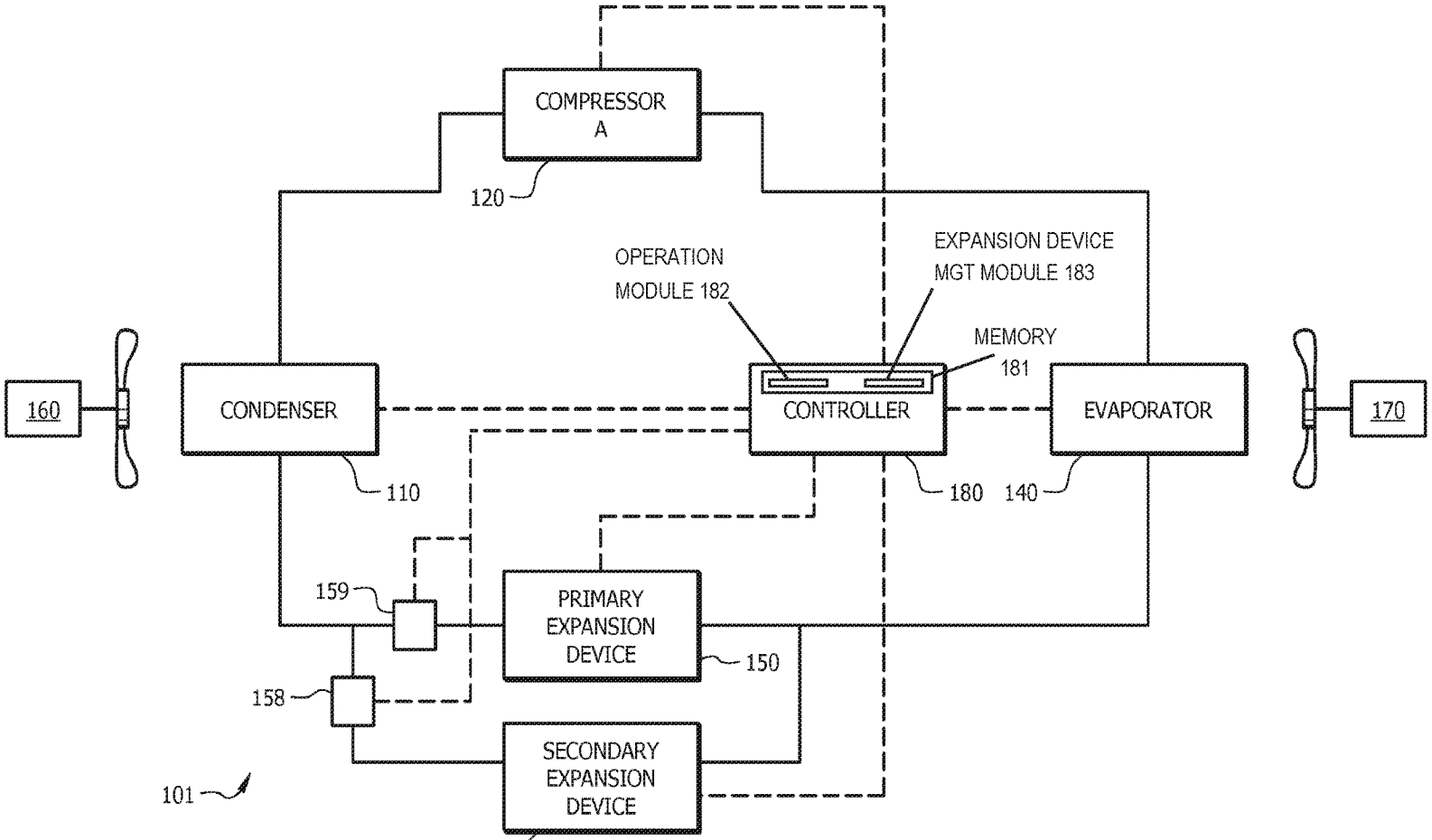
FIG. 1B illustrates an implementation of an example air conditioner with more than one valve for managing refrigerant flow to expansion devices.

In some implementations, the air conditioner may include more than one valve to manage refrigerant flow to the primary expansion device 150 and/or the secondary expansion device 155. For example, as illustrated in FIG. 1B, the air conditioner 101 may include a first valve 158 and a second valve 159. In some implementations, the first valve 158 and/or the second valve 159 may include solenoid valves. The first valve 158 may be coupled to a line that couples the condenser 110 and the primary expansion device 150. The first valve 158 may allow and/or restrict fluid flow to the primary expansion device 150. The second valve 159 may be coupled to a line that couples the condenser 110 to the secondary expansion device 155. The second valve 159 may allow and/or restrict fluid flow to the secondary expansion device 155.

Thus, when a controller of the air conditioner determines whether to allow refrigerant flow to the primary expansion device and/or the secondary expansion device (e.g., a determined direction of flow), the controller may determine the valve setting associated with the determined direction of refrigerant flow. The controller may then transmit a signal to the valve(s) to adjust and/or maintain the valve setting of the valve(s) such that it is approximately equal to the determined valve setting and allows refrigerant flow in the determined direction of flow.

Figure 1C:
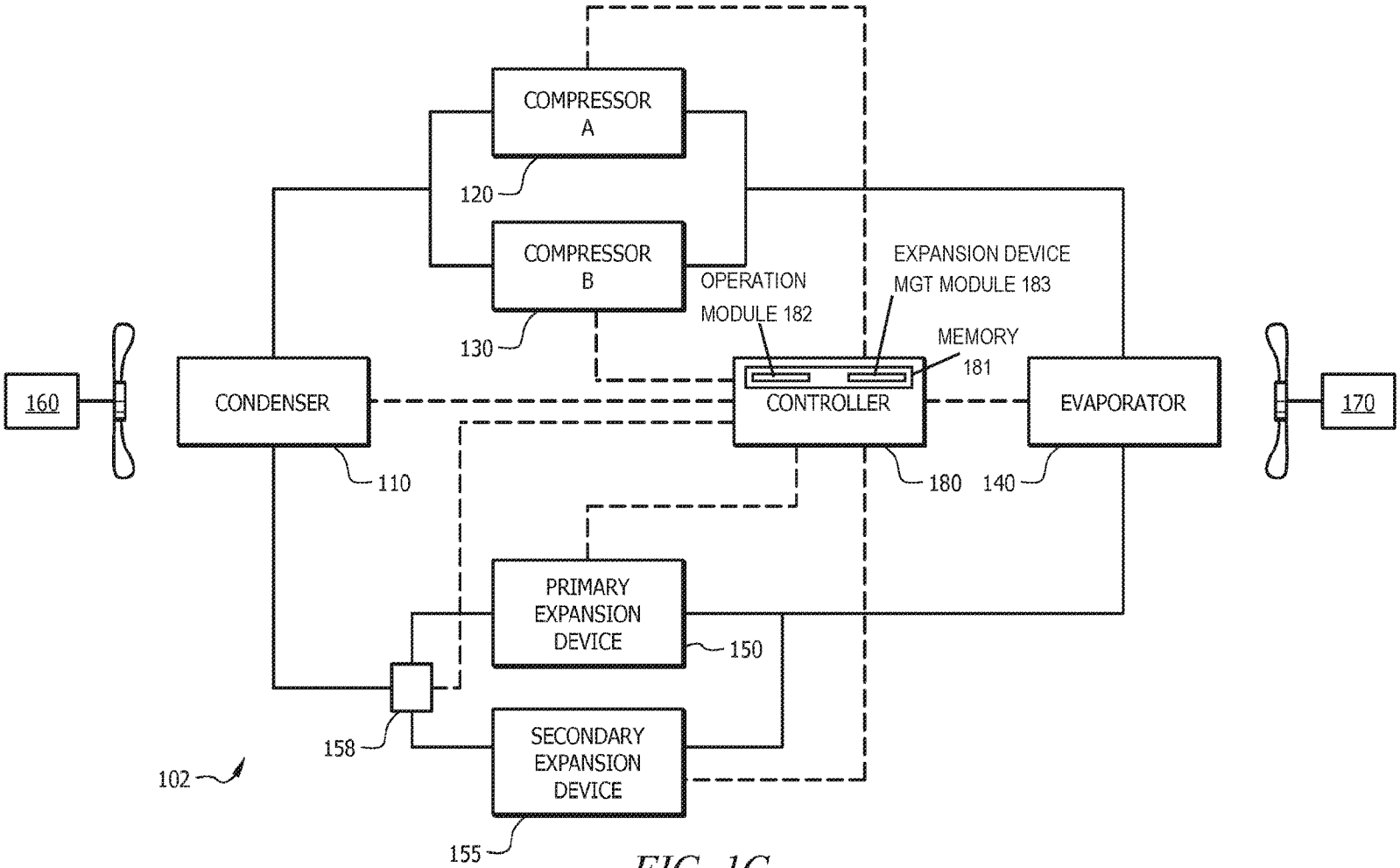
FIG. 1C illustrates an implementation of an example air conditioner with more than one compressor.

In some implementations, the air conditioner may include more than one compressor (e.g., two compressors coupled in series and/or parallel, a tandem compressor with two compressors, and/or a tandem compressor with four compressors). FIG. 1C illustrates an implementation of an example air conditioner 102 with a set of compressors that includes more than one compressor. As illustrated, the air conditioner 102 may include compressor A 120 and a compressor B 130. The compressors (e.g., compressor A 120 and compressor B 130) of the air conditioner may include any appropriate type of compressor (e.g., single stage compressors, more than one stage such as multistage compressors, and/or variable stage compressor) and/or arrangement of compressors (e.g., in series and/or in parallel). As illustrated, compressor A 120 and compressor B 130 may be disposed in a tandem assembly. The tandem assembly may allow more than one compressor (e.g., compressor A 120 and compressor B 130) to share discharge lines and suction lines.

Compressor A 120 and Compressor B 130 may be independently operable, in some implementations. For example, compressor A 120 may be allowed to operate and compressor B 130 may be restricted from operation.

The set of compressors may include more than one setting. The settings may correspond to various operations of the air conditioner. For example, when an air conditioner receives a request for operation, the controller may determine the appropriate settings for each component of the air conditioner. Utilizing a set of compressors with more than one setting may allow satisfaction of received requests for operation with reduced costs and/or increased efficiency (e.g., as compared with running an air conditioner compressor at full load for all requests for operation). In some implementations, the set of compressors may include two single stage compressors. Thus, the set of compressors may include three settings: a first setting associated with the compressors being off (e.g., both compressors off); a second setting associated with the compressors being partially on (e.g., one compressor is allowed to operate and one compressor is restricted from operating); and a third setting associated with the compressors being on (e.g., both compressors are on).

In some implementations, the set of compressors may include compressors with more than one discrete stage and/or variable stages. The number of settings of the compressor set may be based on the number of compressors and the number of stages associated with each compressor. For example, the set of compressors may include a low setting and one or more high settings. The low setting may be associated with a lower volumetric flow rate of refrigerant proximate at least a portion of the outlet of the set of compressors (e.g., proximate an outlet of one of the compressors, proximate a shared outlet of the compressors, and/or proximate an outlet of more than one compressor) than high settings. In some implementations, the set of compressors may include more than one high setting. For example, the set of compressors may include a first high setting and a second high setting, where the second high setting is associated with a higher volumetric flow rate exiting at least a portion of the set of compressors than the first high setting.

In some implementations, a portion of the air conditioner 100, 101, 102 may be disposed outside a building (e.g., an "outdoor portion" on the ground proximate a building and/or on a roof of the building) and a portion of the air conditioner may be disposed inside the building (e.g., an "indoor portion"). For example, the outdoor portion may include condenser 110 and fan 160 and the indoor portion may include the evaporator 140 and fan 170. In some implementations, such as a rooftop unit, the condenser 110, fan 160, compressor A 120 and/or compressor B 130, evaporator 140, fan 170, and the primary expansion device 150 and/or secondary expansion device 155 may be disposed in the outdoor portion. The outdoor and/or indoor portion may be at least partially disposed in housing(s).

During a cooling cycle of the air conditioner 100, 101, 102, cool air may be provided by blowing air (e.g., from fan 170) at least partially through the evaporator 140. The evaporator 140 may evaporate liquid refrigerant in the evaporator. The evaporator may reduce a temperature of the air and the cool air may be provided to a location (e.g., via ducting). The gaseous refrigerant may exit the evaporator 140, and may be compressed by compressor A 120 and compressor B 130, and delivered to a condenser 110. The condenser 110 may condense the gaseous refrigerant by blowing air (e.g., from a fan 160) at least partially through the condenser 130 to remove heat from the gaseous refrigerant.

During operation of the air conditioner, the refrigerant may flow from an outlet of the condenser 110 to the primary expansion device 150 and/or the secondary expansion device 155. The primary expansion device 150 may be associated with a lower exit volumetric flow rate (e.g., volumetric flow rate of the refrigerant flowing from the outlet of the primary expansion device) than the exit volumetric flow rate of the secondary expansion device 155 (e.g., volumetric flow rate of the refrigerant flowing from an outlet of the secondary expansion device 155). By selecting which expansion device(s) the refrigerant will flow through, efficiency (e.g., cost and/or IEER) of the air conditioner may be increased. The controller 180 (e.g., a module of the controller) of the air conditioner may determine which expansion device(s) the refrigerant will flow through based on properties of the set of compressors, such as compressor settings and/or flow rates of refrigerant exiting at least a portion of the set of compressors (e.g., flow rate proximate an outlet of a compressor, flow rate proximate a discharge line of a tandem assembly of compressors, and or flow rate proximate an outlet of more than one compressor).

Figure 2:
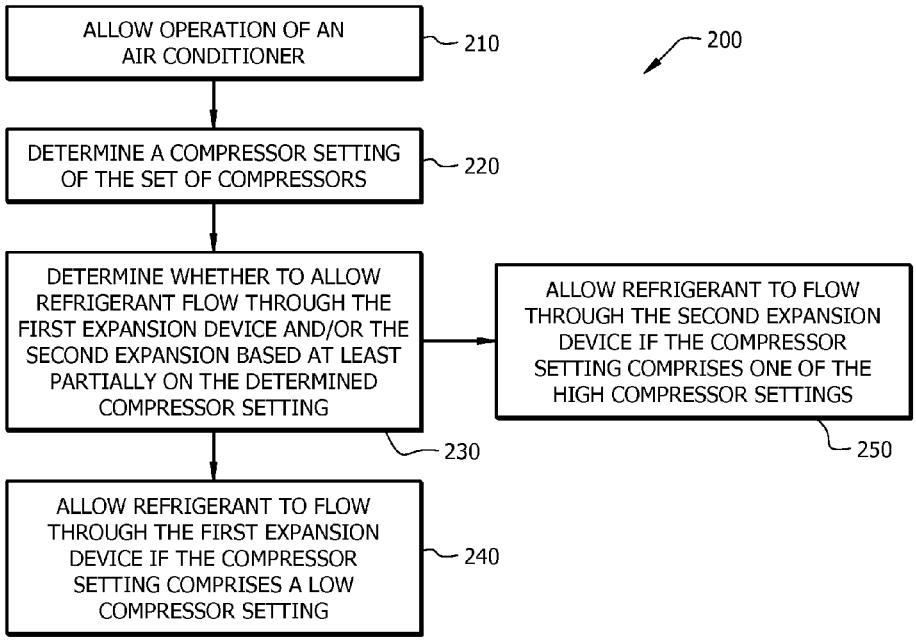
FIG. 2 illustrates an implementation of an example process for operation of an air conditioner.

FIG. 2 illustrates an implementation of an example process 200 for operation of an air conditioner. Operation of an air conditioner may be allowed (operation 210). The controller may receive a request for operation of the air conditioner. For example, a user may request operation of an air conditioner. The request may include set points, such as temperature and/or humidity.

The controller may determine one or more settings for the components of the air conditioner based on the received request. A compressor setting of a set of compressors may be determined (operation 220). A controller (e.g., a module of the controller) may determine the compressor setting based at least partially on the request for operation of the air conditioner and/or the operational properties (e.g., settings). For example, a request may include a set point and the controller may determine the operational properties (e.g., compressor settings, condenser settings, valve settings, and/or time of operation) of the air conditioner to satisfy the request. The compressor setting may be determined based on the determined operational properties. For example, if a determined operational property is that operation of a first compressor is allowed and operation of a second compressor is restricted, then the controller may determine that the compressor setting is associated with a low compressor setting. If a determined operational property is that two compressors be allowed to operate, a compressor setting may be associated with one of the high compressor settings.

A determination may be made whether to allow refrigerant to flow through the first expansion device and/or the second expansion device at least partially based on the determined compressor setting (operation 230). The controller (e.g., a module of the controller) may retrieve a set of associations among valve settings and compressor settings and determine the valve setting to allow based at least partially on the retrieved associations. For example, a first valve setting may be associated with a low compressor setting and a second valve setting may be associated with at least one of the high compressor settings.

Refrigerant may be allowed to flow through the first expansion device if the compressor setting comprises a low compressor setting (operation 240). For example, the first expansion device of the air conditioner may be associated with a lower volumetric flow rate than the secondary expansion device. Thus, when the compressor setting is a low compressor setting, refrigerant flow may be allowed through the primary expansion device and/or restricted through the secondary expansion device. By allowing the refrigerant to flow through a low speed primary expansion device when a compressor setting is low (e.g., associated with a low volumetric flow rate proximate an outlet of compressor(s)), efficiency of the air conditioner may be increased (e.g., when compared with allowing the refrigerant to pass through the same high speed regardless of the refrigerant flow rate).

Refrigerant may be allowed to flow through the second expansion device if the compressor setting comprises one of the high compressor settings (operation 250). For example, the second expansion device of the air conditioner may be associated with a higher volumetric flow rate than the primary expansion device. Thus, when the compressor setting is one of the high compressor settings, refrigerant flow may be allowed through the secondary expansion device. In some implementations, refrigerant flow may be restricted through the primary expansion device. Since allowing the refrigerant to flow through the low speed primary expansion device may cause instabilities during operation and/or mechanical failure (e.g., high pressure due to the accumulation of refrigerant in portions of the air conditioner due to the size of the orifice), the refrigerant may be allowed to flow through a high speed primary expansion device when a compressor setting is high (e.g., associated with a high volumetric flow rate proximate an outlet of compressor(s)).

Process 200 may be implemented by various systems, such as system 100. In addition, various operations may be added, deleted, and/or modified. For example, a compressor setting of the set of compressors may be determined based at least partially on volumetric flow rates of at least a portion of the set of compressors. In some implementations, a compressor setting of a set of compressors may be determined based on signals that the controller transmits and/or will transmit to one or more of the compressors. The compressor setting of a set of compressors may be determined based at least partially on flow rates of refrigerant exiting at least a portion of the set of compressors.

In some implementations, a refrigerant may be allowed to flow through the primary expansion device and the secondary expansion device concurrently. For example, the set of compressors may include a low compressor setting and one or more high compressor settings, such as a first high setting and a second high setting. The second high setting may be associated with a higher volumetric flow rate exiting the set of compressors than the first high compressor setting. For example, if the air conditioner includes two compressors, a single stage compressor A and a two stage compressor B, then settings of the compressor may include: a low setting (e.g., operation of compressor A allowed and operation of compressor B restricted); a first high setting (e.g., operation of compressor A allowed and operation of compressor B allowed at a low setting); and a second high setting (e.g., operation of compressor A allowed and operation of compressor B allowed at a high setting). Since the volumetric flow rate of refrigerant exiting the compressor set may be higher at the second high setting than the first high setting, during operation at the second high setting of the compressor set, refrigerant flow may be allowed through the primary expansion device and the secondary expansion device to inhibit instabilities and/or mechanical failure due to the size of the expansion device.

In some implementations, a compressor setting may not be determined. The direction of refrigerant flow may be based on flow rates of refrigerant exiting at least a portion of the compressors. For example, the flow rate proximate an outlet of at least a portion of the set of compressors may be determined (e.g., by one or more sensors of the air conditioner). The controller may retrieve predetermined flow rate values and/or predetermined ranges of flow rate values. The determined flow rate may be compared to the predetermined flow rate values and/or predetermined ranges of flow rate values and a direction of refrigerant flow may be determined based on the comparison. For example, if the determined flow rate is less than a predetermined first flow rate then refrigerant may be allowed to flow to the primary expansion device and restricted from flowing to the second expansion device. When a determined flow rate is greater than or equal to a second flow rate (e.g., the same or different than the first flow rate), then the refrigerant may be allowed to flow to the secondary expansion device. In some implementations, refrigerant flow to the primary expansion device may be restricted if the determined flow rate is greater than the second predetermined flow rate and less than a third predetermined flow rate. When the determined flow rate is greater than or equal to the third predetermined flow rate, refrigerant may be allowed to flow to the secondary expansion device and the primary expansion device.

Figure 3:
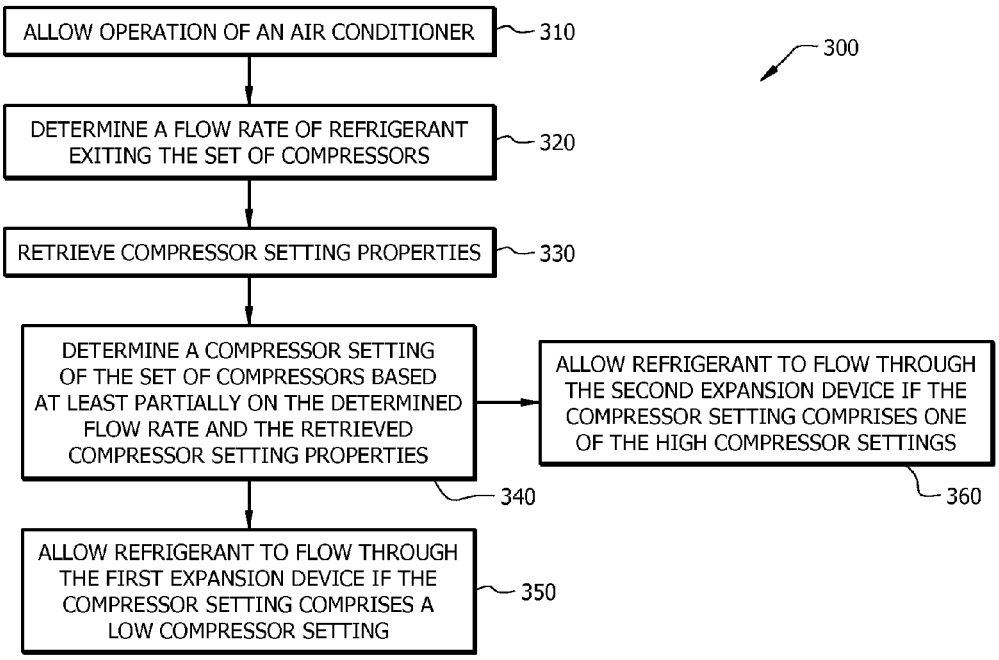
FIG. 3 illustrates an implementation of an example process for operation of an air conditioner.

In some implementations, compressor settings may be based on measured flow rates proximate the compressors. FIG. 3 illustrates an implementation of an example process 300 for operation of an air conditioner. Operation of an air conditioner may be allowed (operation 310). For example, request for operation may be received (e.g., by the controller). The air conditioner may have previously been operating and/or off and the request may change operation(s) of the air conditioner, in some implementations. The efficiency of the air conditioner may be reduced if operation of the air conditioner is maintained in the current configuration for the received request, and thus, the controller may determine settings for one or more of the components of the air conditioner.

A flow rate of refrigerant exiting the set of compressors may be determined (operation 320). For example, sensor(s) of the air conditioner may measure a flow rate. The sensors may be disposed proximate an outlet of the set of compressors and/or portions thereof (e.g., proximate an outlet of a compressor and/or in a discharge line). The flow rate of refrigerant may be determined as an absolute value and/or in a range (e.g., low volumetric flow rate, first high volumetric flow rate, second high volumetric flow rate, and/or third high volumetric flow rate).

One or more compressor setting properties may be retrieved (operation 330). For example, compressor setting properties may be stored in a memory of the air conditioner. A compressor setting property may include value(s) and/or ranges of value(s) (e.g., ranges of absolute numbers and/or labeled ranges, such as low, first high, and/or second high volumetric flow rate) for the flow rates associated with a compressor setting; whether a predetermined compressor is allowed to operate and/or is restricted in a compressor setting; the number of compressors in an air conditioner when associated with a compressor setting, and/or other appropriate properties.

A compressor setting of the set of compressors may be determined based at least partially on the determined flow rate and one or more of the retrieved compressor setting properties (operation 340). For example, a determined volumetric flow rate may be compared to one or more retrieved compressor setting properties to determine which compressor setting includes criteria satisfied by the determined volumetric flow rate.

Refrigerant may be allowed to flow through the first expansion device if the compressor setting comprises a low compressor setting (operation 350). For example, the first expansion device may be associated with allowing refrigerant to flow from an outlet of the first expansion device at a lower volumetric flow rate than refrigerant flowing from an outlet of a second expansion device. Refrigerant flow through the secondary expansion device may be restricted, in some implementations.

Refrigerant may be allowed to flow through the second expansion device if the compressor setting comprises one of the high compressor settings (operation 360). For example, the second expansion device may be associated with allowing refrigerant to flow from an outlet of the second expansion device at a higher volumetric flow rate than refrigerant flowing from an outlet of the first expansion device. Refrigerant flow through the primary expansion device may be restricted, in some implementations.

Process 300 may be implemented by various systems, such as system 100. In addition, various operations may be added, deleted, and/or modified. In some implementations, process 300 may be performed in combination with other processes such as process 200. For example, the condenser may be a microchannel condenser. In some implementations, the controller may determine whether to modify the valve setting of an air conditioner by determining the current valve setting (e.g., by retrieving the current valve setting from a memory of the air conditioner) and comparing the current valve setting to a determined valve setting to satisfy a request. The valve setting may be adjusted based on the comparison (e.g., by the controller of the air conditioner).

In some implementations, refrigerant flow may be allowed through the primary expansion device and the secondary expansion device. Allowing refrigerant flow through the primary and the secondary expansion device may allow an air conditioner to utilize more valve settings to manage flow through the expansion devices and thus efficiency.

In some implementations, the set of compressors may include a first high setting and a second high setting, where the second high setting is associated with a higher volumetric flow rate exiting at least a portion of the set of compressors. Refrigerant may be allowed to flow through the secondary expansion device and may be restricted from flowing through the primary expansion device when the compressor setting is determined to be the first high setting. In some implementations, refrigerant may be allowed to flow through the primary and the secondary expansion devices when the compressor setting is determined to be the second high setting.

In some implementations, a valve setting may be determined. The valve setting may be associated with a direction of flow of the refrigerant. For example, a first valve setting may allow fluid flow through the primary expansion device and restrict fluid flow through the secondary expansion device. A second valve setting may allow fluid flow through the secondary expansion device and restrict fluid flow through the primary expansion device. A third valve setting may allow fluid flow through the primary expansion device and the secondary expansion device. A fourth valve setting may restrict fluid flow through the primary expansion device and the secondary expansion device. In some implementations, the compressors settings may be associated with valve settings and the associations may be stored in a memory of the air conditioner. After a compressor setting is determined, a valve setting may be determined based on associations retrieved from a memory of the air conditioner. The controller may transmit signals to the valve(s) of the air conditioner based on the determined valve setting and refrigerant flow through the expansion device(s) may be based at least partially on the valve settings.

Although volumetric flow rates have been described, other flow rates (e.g., mass flow rates) may be utilized to regulate and/or manage air conditioner operations.

Although a specific controller has been described in FIG. 1, the controller may be any appropriate computer or other programmable logic device. The controller may include a processor that executes instructions and manipulates data to perform operations of the controller. Processor may include a programmable logic device, a microprocessor, or any other appropriate device for manipulating information in a logical manner and memory may include any appropriate form(s) of volatile and/or nonvolatile memory, such as RAM and/or Flash memory.

The memory may include data, such as predetermined property values (e.g., temperatures and/or pressure), Properties of compressor settings, compressor setting criteria, a predetermined high pressure switch value, predetermined high ambient temperature, predetermined volumetric flow rates (e.g., first predetermined volumetric flow rate, second predetermined volumetric flow rates, third predetermined volumetric flow rate), ranges of predetermined volumetric flow rates, various associations (e.g., association between flow rates and compressors settings and/or valve settings and/or compressors settings) and/or any other data useful to the operation of the air conditioner.

In addition, various software may be stored on the memory. For example, instructions (e.g., operating systems and/or other types of software) and/or modules may be stored on the memory. The modules may perform one or more of the operations described in processes 200 and/or 300, such as operating the air conditioner during normal operations (e.g., operations in which the system operates based at least partially on user requests for operation), and determine a direction of refrigerant flow based on properties of the set of compressors and direct fluid flow accordingly.

In some implementations, modules may be combined, such as into a single module or multiple modules. Operation modules, bypass modules, and/or compressor management modules may be distinct modules. In an implementation, operation modules and/or defrost modules may include various modules and/or sub-modules.

A communication interface may allow the controller to communicate with components of the heat pump, other repositories, and/or other computer systems. The communication interface may transmit data from the controller and/or receive data from other components, other repositories, and/or other computer systems via network protocols (e.g., TCP/IP, Bluetooth, and/or Wi-Fi) and/or a bus (e.g., serial, parallel, USB, and/or FireWire). Operations of the heat pump stored in the memory may be updated and/or altered through the communication via network protocols (e.g., remotely through a firmware update and/or by a device directly coupled to the controller).

The controller may include a presentation interface to present data to a user, such as though a monitor and speakers. The presentation interface may facilitate receipt of requests for operation from users.

A client (e.g., control panel in field or building) may allow a user to access the controller and/or instructions stored on the controller. The client may be a computer system such as a personal computer, a laptop, a personal digital assistant, a smart phone, or any computer system appropriate for communicating with the controller. For example, a technician may utilize a client, such as a tablet computer, to access the controller. As another example, a user may utilize a client, such as a smart phone, to access the controller and request operations.

Although FIG. 1 provides one example of controller that may be used with the disclosure, controller can be implemented through computers such as servers, as well as a server pool. For example, controller may include a general-purpose personal computer (PC) a Macintosh, a workstation, a UNIX-based computer, a server computer, or any other suitable device. In some implementations, a controller may include a programmable logic device. For example, the controller may be mounted to a wall of a location in which air conditioning may be provided. According to one implementation, controller may include a web server. Controller may be adapted to execute any operating system including UNIX, Linux, Windows, or any other suitable operating system. Controller may include software and/or hardware in any combination suitable to provide access to data and/or translate data to an appropriate compatible format.

Various implementations of the systems and techniques described herein can be realized in digital electronic circuitry, integrated circuitry, specially designed ASICs (application specific integrated circuits), computer hardware, firmware, software, and/or combinations thereof. These various implementations can include implementations in one or more computer programs that are executable and/or interpretable on a programmable system, including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable signal(s) may be non-transitory waves and/or non-transitory signals.

Although mechanical failure and mechanical failure events have been described as conditions that cause mechanical failure, conditions that precede mechanical failure may also be included, such as excessive wear on parts.

Although users have been described as a human, a user may be a person, a group of people, a person or persons interacting with one or more computers, and/or a computer system.

Various described patents and patent applications have been incorporated by reference. The described patents and patent applications are incorporated by reference to the extent that no conflict exists between the various described systems and/or processes and the described patents and patent applications. Any portion(s) of such described patents and patent applications that are in conflict with the various described systems and/or processes are not incorporated by reference.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a valve setting" includes a combination of two or more valve settings and reference to "an expansion device" includes different types and/or combinations of expansion devices.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. An air conditioner comprising:

a condenser including an outlet;

one or more compressors, the one or more compressors comprising:

a low compressor setting; and a first and a second high compressor settings, wherein a volumetric flow rate of refrigerant exiting the one or more compressors is greater at the first and second high compressor settings than at the low compressor setting;

a first expansion device fluidly coupled to the set of compressors such that the first expansion device permits fluid to exit the first expansion device at a first flow rate, wherein the first expansion device is an electronic expansion valve;

a second expansion device fluidly coupled to the one or more compressors such that the second expansion device permits fluid to exit the second expansion device at a second flow rate, wherein the first expansion device and the second expansion device are coupled in parallel;

a controller coupled to a plurality of components of the air conditioner, the controller comprising a memory storing an operation module and an expansion device management module each being executable by a processor, wherein the controller is operable to:

via the operation module, receive requests for operation and determine response to the requests for operation and operate the plurality of components of the air conditioner;

via the expansion device management module, allow operations of the air conditioner, comprising:

measure a flow rate in the air conditioner;

compare the measured flow rate to a plurality of flow rate ranges stored in a memory, the plurality of flow rate ranges associated with the low, first high, and second high compressor settings;

allow refrigerant from the outlet of the condenser to flow through the first expansion device if the measured flow rate is associated with the low compressor setting;

allow refrigerant from the outlet of the condenser to flow through the second expansion device if the measured flow rate is associated with the first high compressor setting; and allow refrigerant from the outlet of the condenser to flow through the first and second expansion devices if the measured flow rate is associated with the second high compressor setting.

2. The air conditioner of claim 1, further comprising a reversing valve, and wherein the reversing valve comprises:

a first valve setting adapted to allow refrigerant flow through the first expansion device; and a second valve setting adapted to allow refrigerant flow through the second expansion device.

3. The air conditioner of claim 1, further comprising:

a first valve adapted to regulate flow through the first expansion device; and a second valve adapted to regulate flow through the second expansion device.

4. The air conditioner of claim 1, wherein the one or more compressors comprises a first compressor and a second compressor coupled in a tandem compressor assembly.

5. The air conditioner of claim 1, wherein the one or more compressors comprises a variable speed compressor, and wherein at least one of the first expansion device or the second expansion device comprises a thermal expansion device.

6. The air conditioner of claim 1, wherein at least one of the one or more of compressors comprises more than one stage of operation.

7. The air conditioner of claim 1, wherein the condenser comprises a microchannel condenser.

8. The air conditioner of claim 1, wherein:

the first expansion device comprises a first high speed orifice; and the second expansion device comprises a second low speed orifice.

9. The air conditioner of claim 1 wherein at least one of the first expansion device or the second expansion device comprises a bleed thermal expansion device.

10. A method comprising:

allowing operation of an air conditioner, wherein the air conditioner comprises:

compressor settings comprising a low compressor setting and a first and a second high compressor settings, wherein a volumetric flow rate of refrigerant exiting one or more compressors of the air conditioner is greater at the first high compressor setting than at the low compressor setting, and greater at the second high compressor setting than at the first high compressor setting; and a first expansion device fluidly coupled to the one or more compressors; and a second expansion device fluidly coupled to the one or more compressors and coupled in parallel with the first expansion device;

via an operation module operable in a controller, receiving requests for operation and determining response to the requests for operation and operating a plurality of components of the air conditioner;

via an expansion device management module operable in a controller coupled to the plurality of components of the air conditioner, allowing operations of the air conditioner, comprising:

measuring a flow rate in the air conditioner;

comparing the measured flow rate to a plurality of flow rate ranges stored in a memory, the plurality of flow rate ranges associated with the low, first high, and second high compressor settings;

allowing refrigerant from an outlet of a condenser of the air conditioner to flow through the first expansion device if the measured flow rate is associated with the low compressor setting;

allowing refrigerant from the outlet of the condenser to flow through the second expansion device if the measured flow rate is associated with the first high compressor setting; and allowing refrigerant from the outlet of the condenser to flow through the first and second expansion devices if the measured flow rate is associated with the second high compressor setting.

11. The method of claim 10, wherein determining a compressor setting comprises determining a compressor setting based at least partially on a volumetric flow rate of a refrigerant proximate an outlet of at least one of the one or more compressors of the air conditioner.

12. The method of claim 10, wherein determining a compressor setting comprises:

determining a third volumetric flow rate of refrigerant exiting at least a portion of the one or more compressors;

comparing the determined third volumetric flow rate to a predetermined low flow rate; and identifying the compressor setting as the low compressor setting if the determined third volumetric flow rate is less than the predetermined low flow rate.

13. The method of claim 10, wherein determining a compressor setting comprises:

determining a third volumetric flow rate of refrigerant exiting at least a portion of the one or more compressors;

comparing the determined third volumetric flow rate to a predetermined high flow rate; and identifying the compressor setting as one of the high compressor settings if the determined third volumetric flow rate is greater than the predetermined high flow rate.

14. An air conditioner comprising:

a microchannel condenser:

a first expansion device;

a second expansion device wherein the first expansion device and the second expansion device are coupled in parallel;

at least one valve managing refrigerant flow to at least one of the first expansion device or the second expansion device;

one or more compressors fluidly coupled to the first and second expansion devices;

one or more sensors adapted to measure one or more third volumetric flow rates exiting at least a portion of the one or more compressors;

a memory storing one or more predetermined flow rates; and and a controller adapted to:

via an operation module operable in the controller, receive requests for operation and determine response to the requests for operation and operate a plurality of components;

via an expansion device management module operable in the controller coupled to the plurality of components of the air conditioner, allow operations of the air conditioner, comprising:

measure a flow rate in the air conditioner;

compare the measured flow rate to a plurality of flow rate ranges stored in the memory, the plurality of flow rate ranges associated with a low, first high, and second high compressor settings;

allow refrigerant from an outlet of a condenser of the air conditioner to flow through the first expansion device if the measured flow rate is associated with the low compressor setting;

allow refrigerant from the outlet of the condenser to flow through the second expansion device if the measured flow rate is associated with the first high compressor setting; and allow refrigerant from the outlet of the condenser to flow through the first and second expansion devices if the measured flow rate is associated with the second high compressor setting.

15. The air conditioner of claim 14, wherein at least one of the valves comprises a reversing valve, and wherein the reversing valve comprises:

a first valve setting adapted to allow refrigerant flow through the first expansion device; and a second valve setting adapted to allow refrigerant flow through the second expansion device.

16. The air conditioner of claim 14, wherein the at least one valve comprises a first valve adapted to regulate flow through the first expansion device and a second valve adapted to regulate flow through the second expansion device.

17. The air conditioner of claim 14, wherein the one or more compressors comprises a first compressor and a second compressor coupled in a tandem assembly.

18. The air conditioner of claim 14, wherein at least one of the one or more compressors comprises more than one stage of operation.

19. The air conditioner of claim 14, wherein at least one of the predetermined flow rates comprises a predetermined high flow rate greater than the first predetermined flow rate; and wherein the controller is further adapted to:

retrieve the predetermined high flow rate from the memory of the air conditioner; and allow refrigerant from an outlet of the condenser to flow through the first expansion device and the second expansion device if at least one of the determined third volumetric flow rates is greater than the predetermined high flow rate.

* * * * *